United States Patent [19]

McWilliams

[11] 4,308,080

[45] Dec. 29, 1981

[54] METHOD OF SHAPING COILS

[75] Inventor: Joseph A. McWilliams, Droitwich, England

[73] Assignee: Micropore International Limited, Droitwich, England

[21] Appl. No.: 119,062

[22] Filed: Feb. 6, 1980

[30] Foreign Application Priority Data

Feb. 7, 1979 [GB] United Kingdom ..... 04323/79

[51] Int. Cl.[3] ..... C21D 1/40

[52] U.S. Cl. ..... 148/12 R; 29/611; 140/71 C; 148/154

[58] Field of Search ..... 148/4, 130, 154, 12 R, 148/12 B, 12.1, 13, 13.1, 14, 37, 135; 29/611, 612, 620; 219/149, 153, 468, 464, 553; 338/311, 285, 286, 267; 140/71.5, 71.6, 71 C

[56] References Cited

U.S. PATENT DOCUMENTS

| | | | |
|---|---|---|---|
| 2,288,660 | 7/1942 | von Kantzow | 75/126 F X |
| 3,735,328 | 5/1973 | Yagi | 338/267 |
| 3,798,759 | 3/1974 | Gerds | 29/611 |
| 3,992,161 | 11/1976 | Cairns et al. | 75/126 R X |
| 4,139,833 | 2/1979 | Kirsch | 29/612 |
| 4,207,672 | 6/1980 | Wohlert | 29/611 |

FOREIGN PATENT DOCUMENTS

| | | |
|---|---|---|
| 431333 | 8/1935 | United Kingdom . |
| 489137 | 7/1938 | United Kingdom . |
| 772671 | 4/1957 | United Kingdom . |
| 773496 | 4/1957 | United Kingdom . |
| 933415 | 8/1963 | United Kingdom . |

OTHER PUBLICATIONS

Clark et al, *Physical Metallurgy for Engineers,* D. Van Nostrand Company, Inc., N.Y., 1962, pp. 334–337.

*Primary Examiner*—Peter K. Skiff
*Attorney, Agent, or Firm*—Pollock, Vande Sande & Priddy

[57] ABSTRACT

The invention relates to the shaping of coils in the form of helically wound bare wires, particularly for use in "smooth top" cookers. In so-called "smooth top" cookers an unprotected helically coiled wire is secured in an electrically and thermally insulative base to transmit heat primarily by radiation through a smooth top, normally of glass ceramic. The coils used in such cookers are normally very springy and require careful securement if they are not to free themselves during the life of the cooker. According to the present invention, the stresses which cause this springy resilience can be relieved by holding a coil in a groove of the desired configuration and heating it, normally to the annealing temperature of the material of the coil. The subsequently cooled coil will then hold its shape and not tend to straighten and can be more easily held in place in the cooker.

8 Claims, 3 Drawing Figures

METHOD OF SHAPING COILS

BACKGROUND TO THE INVENTION

This invention relates to a method of shaping coils and has particular application in the shaping of coils comprising helically wound bare wires for use in a radiant heater of a smooth top cooker in which there is little or no other constraint on the winds of the coil.

A "smooth top" cooker is one in which a smooth top, normally of glass ceramic, overlays one or more generally circular electric heater elements supported on a layer of thermal and electrical insulating material such that the element is spaced from the top. In use, a utensil placed on the top over an element is heated by the transmission of heat from an element to and through the top by air convection, conduction and infra red radiation. Such elements are referred to as "radiant heaters". The insulating material substantially prevents heat being transmitted away from the element except towards the top and as the preferred materials for the top are essentially thermally non-conductive, only areas of the top which are "exposed" to the element will be heated. In order to prevent heat being transmitted to parts of the top not covered by a utensil placed thereon, a peripheral wall of insulating material is also normally provided around the element.

In radiant heaters of the above kind, the coil used is typically an iron chromium aluminium resistance heating wire and is very springy in nature. Reference is directed to our copending application Ser. No. 118,951 which is directed to a development in radiant heaters of this type. The complex shapes now used in radiant heaters require the heating coil to be very firmly secured to its support. This can be time consuming and expensive, and can also damage the insulating material of the support. The present invention is a method by which the securement of a coil to its support in a radiant heater is facilitated.

SUMMARY OF THE INVENTION

According to the invention, a coil in the form of an helically wound bare wire is shaped by placing and holding it in a groove having the desired configuration; heating the coil to a temperature at which the bending stresses are relieved; and cooling the coil. The temperature would normally be the annealing temperature of the material of the coil and for an iron chromium aluminium resistance heating wire, is in the range 700° C. to 900° C. The coil may be heated by passing an electric current through it in the same way as would be carried out when the coil was in use. While the voltage is not critical, it would normally be greater than that to which the coil would be subject in normal use to reduce the time during which the voltage must be applied to bring the material of the coil to its annealing temperature. 500 volts is a typical value for a standard 6 mm diameter coil made from iron chromium aluminium resistance wire which normally operates in the range 200 to 250 volts.

The annealing temperature of a metal or alloy is that at which recrystallization takes place. Where the material has been deformed, as has a coil in the method of the present invention, the new crystal structure will be in stable equilibrium and the deformed coil will loose its tendency to straighten. The principle of annealing work-hardened metals to achieve stability is discussed in "Process and Physical Metallurgy" by James E. Garside, second edition published by Charles Griffin and Company in 1957, Page 225 ff.

The groove in which the coil is placed during the stress relieving step is formed in an electrically and thermally insulating material which may be for example Sindanyo (an asbestos cement) and/or ceramic and is normally deep enough to hold the coil without separate means being provided for retaining it therein. A certain amount of shrinkage does take place after heating although this is only small and typically about 1.25%. The groove will usually have a width between 0.5 and 5% larger than the diameter of the coil to provide for ease of removal.

The method of the invention enables sharp turns to be formed in a coil without imposing great strain on the means by which it is subsequently secured in for example a radiant heater, and the desired configuration may be achieved merely by bending and without any unwinding of the coil being necessary. This considerably reduces the labour costs required and of course foregoes the necessity of connecting spaced portions of coil by other means. It also reduces the amount of securement required, meaning fewer staples where this is the only securement used. The staples used in radiant heaters of the kind to which the invention relates are expensive components and thus a considerable capital saving can be made. In radiant heaters, it also facilitates the provision of a uniform heating surface, the coil being continuous and substantially uniform in wire density throughout its length.

The particular advantage of the invention in connection with radiant heaters lies in the fact that minimal securing means are required, such securing means normally having a deleterious effect upon the efficiency of the heater. For example, in the radiant heater described in our copending application referred to above, the coil can merely be placed in a shallow groove in a base material and secured by staples or cement at well spaced locations therealong.

BRIEF DESCRIPTION OF THE DRAWINGS

An embodiment of the invention will now be described by way of example and with reference to the accompanying drawings wherein.

DESCRIPTION OF A PREFERRED EMBODIMENT

Figure 1:
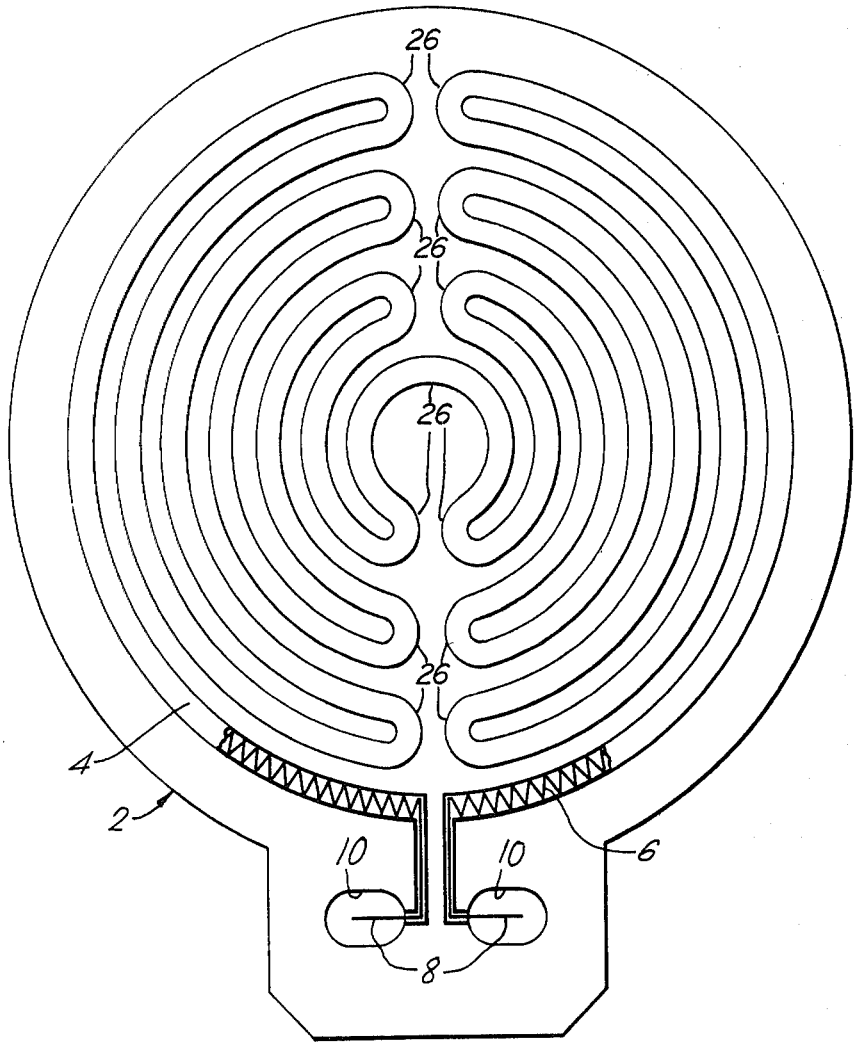
FIG. 1 is a plan view of a former having the groove into which a coil is pressed before heating.

The former illustrated in FIG. 1 is for shaping a coil for a radiant heater of generally circular configuration. The former 2 comprises a block of Sindanyo machined with a groove 4 for receiving a coil 6. The groove extends along the tortuous path shown to provide substantial coverage of the circular area. The ends of the coil are welded to connection plates 8 which fit into openings 10 for connection to a source of electrical supply (not shown) to heat the coil as described below. The groove is formed to about 60% of the thickness of the former 2 and for a given coil, slightly deeper than the coil diameter. The sides of the groove are chamfered at the top to facilitate feeding of the coil thereinto. The width of the groove is between 0.5 and 5% larger than the diameter of the coil.

Figure 2:
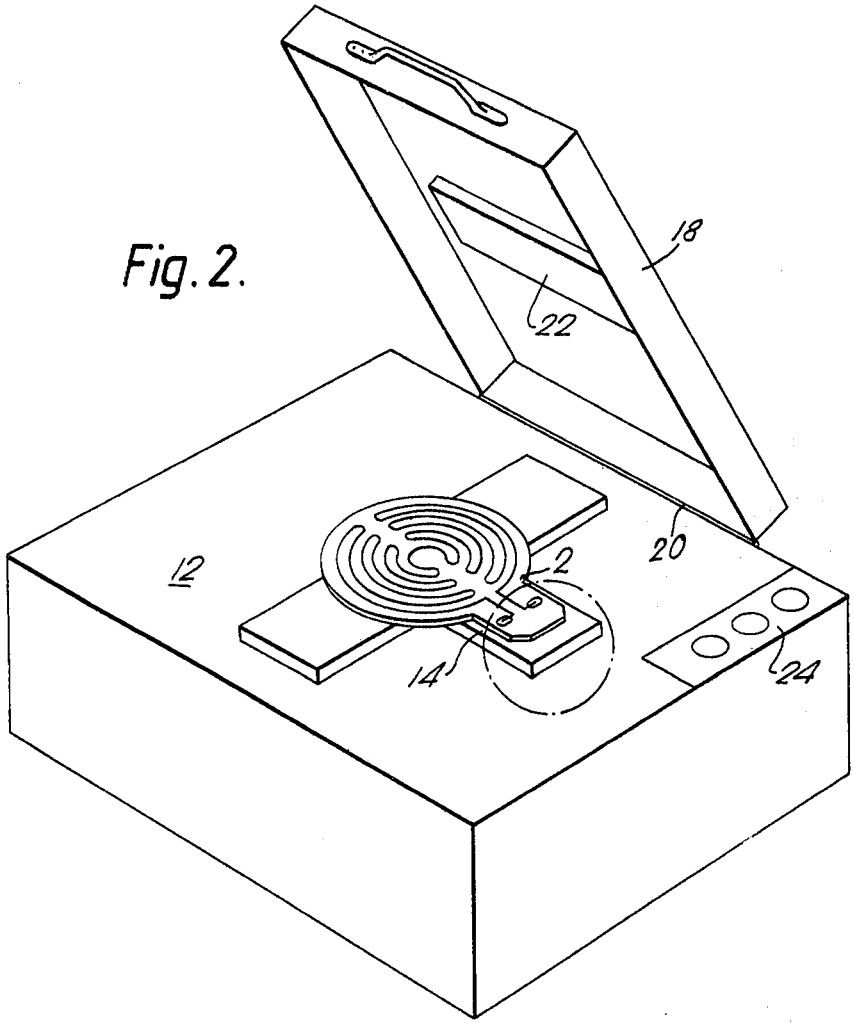
FIG. 2 is a perspective view of a unit for heating a shaped coil with a former in place therein.
Figure 3:
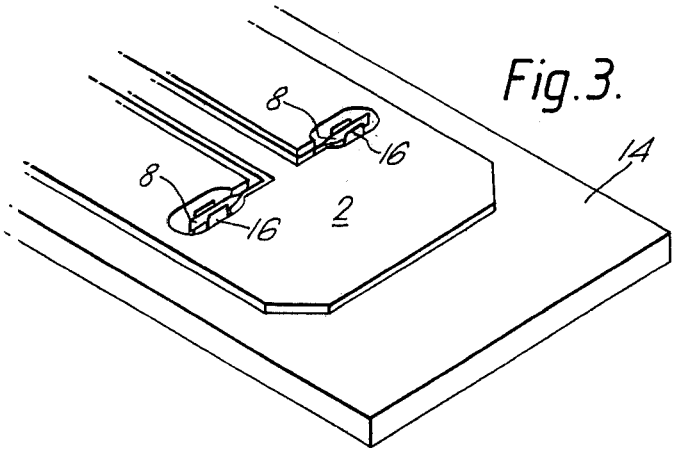
FIG. 3 is a detail view of the ringed portion of FIG. 2.

The unit shown in FIGS. 2 and 3 comprises a base 12 with a T-shaped platen 14 thereon. Through the base of the "T" extend two sprung electrical connectors 16 in which the plates 8 are located when the former 2 and coil 6 are placed in the unit. The cover 18, which is hinged at 20 contains a platen 22 which engages the former 2 across a diameter to ensure that the coil 6 does not release itself from the former. The platen 22 is of sufficient width to engage the points 26 of maximum curvature of the coil which are generally along this diameter. It is at these points that the coil has a tendency to free itself.

It will be noted that the coil and former are not heat insulated from the environment to any great extent in the heating unit. Maximum dissipation of heat is desirable as both the former and the coil should be handleable as soon as possible after treatment.

In a method according to the invention, a length of coiled bare iron chromium aluminium resistance wire is stretched to the length of the groove and fed into place in the former with the plates 8 in the openings 10. The former 2 is then placed in the unit 12 so that the connectors 16 engage the plates 8. The cover 18 is lowered over the unit, and a switch on control panel 24 operated to apply a potential of approximately 500 V across the plates 8 for about 20 seconds. This will generate sufficient heat in a coil of the shape illustrated in a 200 mm diameter former to anneal the metal of the coil such that it will preserve its shape. The temperature reached is in the range 700° C. to 900° C. At the end of the 20 seconds period, a light in the panel is illuminated indicating that the operator may safely raise the cover and remove the former and coil. The coil will now retain the shape imparted to it by the former. The coil is then removed from the former, allowed to cool in air, and passed to the next stage in the production of a radiant heater.

The above method is described in respect of an iron chromium aluminium resistance wire which is commercially available under the Trade Name FECRALLOY. The method is equally suited to an iron-chromium-aluminium-Yttrium resistance wire commercially available under the Trade Name KANTHAL D. The invention is though not limited to the use of these wires.

While the embodiment of the invention particularly described above includes the use of the platen 22 to hold the wire in the former, it should be appreciated that this need not be necessary. If the depth of the grooves is sufficient, then no additional securement is required. Sometimes though, the cross-section of the groove can be slightly convergent towards its open face to inhibit the coil from releasing itself.

I claim:

1. A method of shaping a coil of helically wound bare wire for use in a radiant heater of a smooth top cooker, said method comprising the steps of deforming and confining said coil in a shape defined by a tortuous groove provided in a forming plate; passing an electric current through said coil such that said coil is heated to a temperature and for a time sufficient to relieve the bending stresses generated in the wire during the deforming and confining step; and cooling and removing said coil from the forming plate, said removed coil substantially retaining said shape of said groove.

2. A method according to claim 1 wherein the forming plate comprises a high temperature insulating material and wherein the groove is deep enough to hold the coil therein.

3. A method according to claim 1 wherein the forming plate comprises a block of insulating material and wherein the coil is held in the groove by a platen which engages the forming plate to cover at least a portion of the groove to secure the coil in place therein.

4. A method according to claim 3 wherein said portion of the groove includes those parts at which the coil is at maximum curvature.

5. A method according to claim 1 wherein the coil is heated to a temperature in the range 700° C. to 900° C. by passing said electric current through it.

6. A method according to claim 1 wherein the coil is formed from an iron chromium aluminum resistance heating wire.

7. A method according to claim 1 wherein the width of the groove is from 0.5 to 5% larger than the diameter of the shaped coil.

8. A coil of helically wound bare wire shaped according to the method of claim 1, 2, 3, 4, 5, 6, or 7 for use in a radiant heater of a smooth top cooker.

* * * * *